US009416688B2

(12) United States Patent
Manther

(10) Patent No.: US 9,416,688 B2
(45) Date of Patent: Aug. 16, 2016

(54) SWITCHABLE FINGER FOLLOWER WITH COMBINED LOST MOTION SPRING AND HYDRAULIC LASH ADJUSTER CLIP

(71) Applicant: Schaeffler Technologies AG & Co. KG, Herzogenaurach (DE)

(72) Inventor: Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 22 days.

(21) Appl. No.: 14/612,725

(22) Filed: Feb. 3, 2015

(65) Prior Publication Data

US 2015/0226095 A1 Aug. 13, 2015

Related U.S. Application Data

(60) Provisional application No. 61/937,318, filed on Feb. 7, 2014.

(51) Int. Cl.

| | |
|---|---|
| ***F01L 1/34*** | (2006.01) |
| ***F01L 1/18*** | (2006.01) |
| ***F01L 1/24*** | (2006.01) |

(52) U.S. Cl.
CPC *F01L 1/18* (2013.01); *F01L 1/2411* (2013.01)

(58) Field of Classification Search
CPC ..... F01L 1/18; F01L 1/2411
See application file for complete search history.

(56) References Cited

U.S. PATENT DOCUMENTS

| | | | | |
|---|---|---|---|---|
| 5,775,280 | A | 7/1998 | Schmidt et al. | |
| 6,470,842 | B2 | 10/2002 | Speil | |
| 7,926,455 | B2 * | 4/2011 | Manther | F01L 1/185 123/90.16 |
| 8,251,032 | B2 | 8/2012 | Manther | |
| 2002/0053326 | A1 | 5/2002 | Seitz | |
| 2011/0023806 | A1 | 2/2011 | Heinemann | |
| 2013/0000582 | A1 | 1/2013 | Church | |
| 2013/0104821 | A1 | 5/2013 | Villemure | |

* cited by examiner

*Primary Examiner* — Zelalem Eshete
(74) *Attorney, Agent, or Firm* — Volpe and Koenig, P.C.

(57) ABSTRACT

A switchable roller finger follower including a combined lost motion spring and hydraulic lash adjuster clip is provided. The switchable roller finger follower includes at least one spring having two coiled spring portions. Each of the two coiled spring portions is wrapped around a respective spring holding pin formed on an inner elongated body. Each one of the at least two coiled spring portions includes a first leg and a second leg. The first legs each extend from a respective one of the two coiled spring portions to engage a spring pallet formed on an outer elongated body. The second legs each contact a bottom portion of the inner elongated body in proximity to a socket portion to act as a retainer for retaining a hydraulic lash adjuster to the inner elongated body.

13 Claims, 6 Drawing Sheets

SWITCHABLE FINGER FOLLOWER WITH COMBINED LOST MOTION SPRING AND HYDRAULIC LASH ADJUSTER CLIP

INCORPORATION BY REFERENCE

The following documents are incorporated herein by reference as if fully set forth: U.S. Provisional Patent Application No. 61/937,318, filed Feb. 7, 2014.

FIELD OF INVENTION

This invention is generally related to a switchable roller finger follower and more particularly to a lost motion spring for a switchable roller finger follower.

BACKGROUND

Switchable roller finger followers with varying lift modes are known. Typically, such finger followers have an outer elongated body with one end that contacts a valve stem. An inner elongated body is located within a cavity of the outer elongated body and houses a cam follower that contacts a cam to provide motion to the finger follower to open or close a valve. One end of the outer elongated body or the inner elongated body contacts a hydraulic lash adjuster. A latching mechanism is used to lock the inner elongated body in a fixed position relative to the outer elongated body. When the inner elongated body is locked via the latching mechanism, the cam translates movement to the finger follower which in turn translates movement to the valve via the valve stem. In order to switch the finger follower to a different lift mode or to deactivate the finger follower, the latching mechanism is released and the inner elongated body is unlocked and can travel freely up and down in conjunction with the cam without transferring the cam motion to the outer body and valve stem. Known finger followers provide lost motion springs to maintain contact between the cam follower and the cam.

Hydraulic lash adjuster clips are also known and are used to retain a support element of a hydraulic lash adjuster to a switchable roller finger follower. Typically, a separately formed clip is required for retaining the hydraulic lash adjuster with the inner elongated body of the finger follower. This entails additional expense in the formation of the inner elongated body to receive the clip, as well as additional parts and costs due to the more complex assembly required.

SUMMARY

It would be desirable to provide a simplified assembly for a switchable roller finger follower, as well as reduced parts and cost. This is achieved by the invention in that a combined lost motion spring and retention element for retaining a hydraulic lash adjuster to the switchable roller finger follower is provided.

In a preferred arrangement, the switchable roller finger follower includes an outer elongated body having a valve stem end and a lash adjuster end. The outer elongated body includes two outer elongated body side walls that are connected by a pin. Each of the side walls includes a spring pallet. The outer elongated body includes an inner cavity located between the side walls. An inner elongated body is positioned in the inner cavity and has a first end pivotally attached to the outer elongated body at said valve stem end via the pin, and a second, lash adjuster end. The inner elongated body includes a socket portion defined at the second end on a bottom portion of the inner elongated body. The second end of the inner elongated body also includes a locking mechanism that is hydraulically actuable to extend two locking pins out from the inner elongated body to engage under the lash adjuster ends of the outer elongated body side walls, in the locked position, and can be moved inwardly so that the outer elongated body is pivotable relative to the inner elongated body about the pin in the unlocked position. Two spring holding pins are located on opposite sides of the inner elongated body at the second end. At least one spring having two coiled spring portions is provided, and each of the two coiled spring portions is wrapped around a respective one of the spring holding pins. Each one of the at least two coiled spring portions includes a first leg and a second leg. Each of the first legs extends from a respective one of the two coiled spring portions to engage a respective one of the spring pallets. Each of the second legs contacts the bottom portion of the inner elongated body in proximity to the socket portion to act as a retainer for retaining a hydraulic lash adjuster to the inner elongated body.

Preferred arrangements with one or more features of the invention are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE PREFERRED EMBODIMENTS

Figure 1:
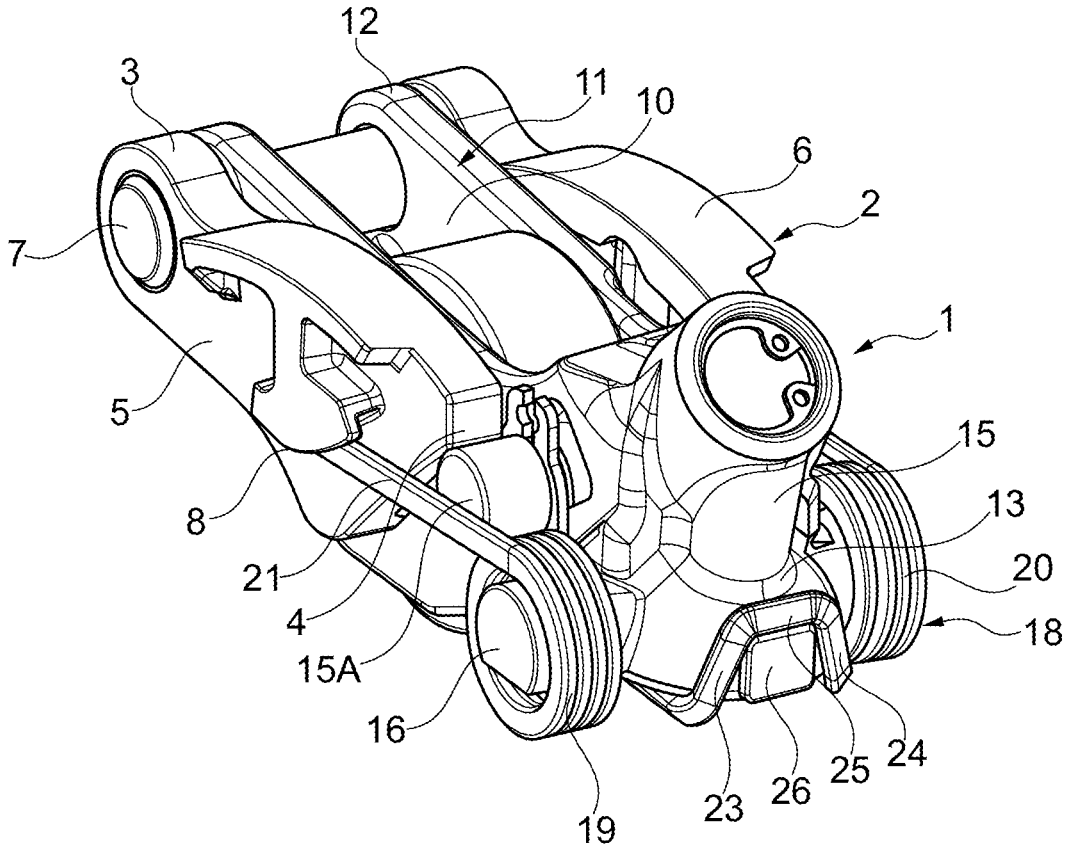
FIG. 1 is a perspective view of a top portion of a switchable roller finger follower according to the present invention.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivates thereof, and words of similar import.

As shown in FIG. 1, a switchable roller finger follower 1 is provided. The switchable roller finger follower 1 includes a primary lever and a secondary lever. One of ordinary skill in the art will recognize that the primary lever includes an end for a lash adjuster and an opposite end for valve actuation. One of ordinary skill in the art will recognize that the secondary lever includes a lost-motion spring pallet. The secondary lever also includes a cam-support surface for engaging with a cam.

In one embodiment, the switchable roller finger follower 1 includes an outer elongated body 2 having a valve stem end 3 and a lash adjuster end 4. The outer elongated body 2 is formed by two outer elongated body side walls 5, 6 that are connected by a pin 7, and each of the side walls 5, 6 includes a spring pallet 8, 9, preferably on a bottom portion. The outer elongated body 2 has an inner cavity 10 located between the outer elongated body side walls 5, 6.

Figure 2:
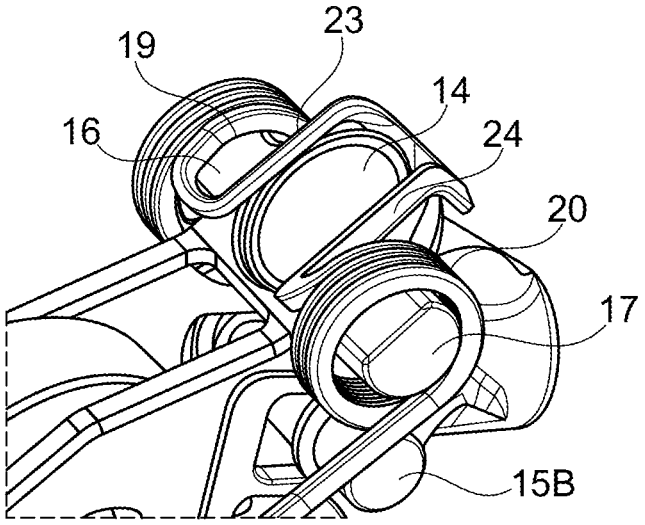
FIG. 2 is a perspective view of a bottom portion of the finger follower according to the invention.

An inner elongated body 11 is positioned in the inner cavity 10 of the outer elongated body 2. The inner elongated body 11 has a first end 12 pivotally attached to the outer elongated body 2 at the valve stem end 3 by the pin 7. The inner elongated body 11 has a second, lash adjuster end 13. As shown in FIG. 2, the inner elongated body 11 includes a socket portion 14 defined at the second end 13 on a bottom portion of the inner elongated body 11. The inner elongated body 11 includes a locking mechanism 15 located at the second end 13 of the inner elongated body 11. The locking mechanism 15 is of the type known in the art, and is hydraulically actuable to extend two locking pins 15A, 15B out from the inner elongated body 11 to engage under the lash adjuster ends 4 of the outer elongated body side walls 5, 6, in the locked position, and can be moved inwardly so that the outer elongated body 2 is pivotable relative to the inner elongated body 11 about the pin 7 in the unlocked position. Two spring holding pins 16, 17 are also located on opposite sides of the inner elongated body 11 at the second end 13.

Figure 3:
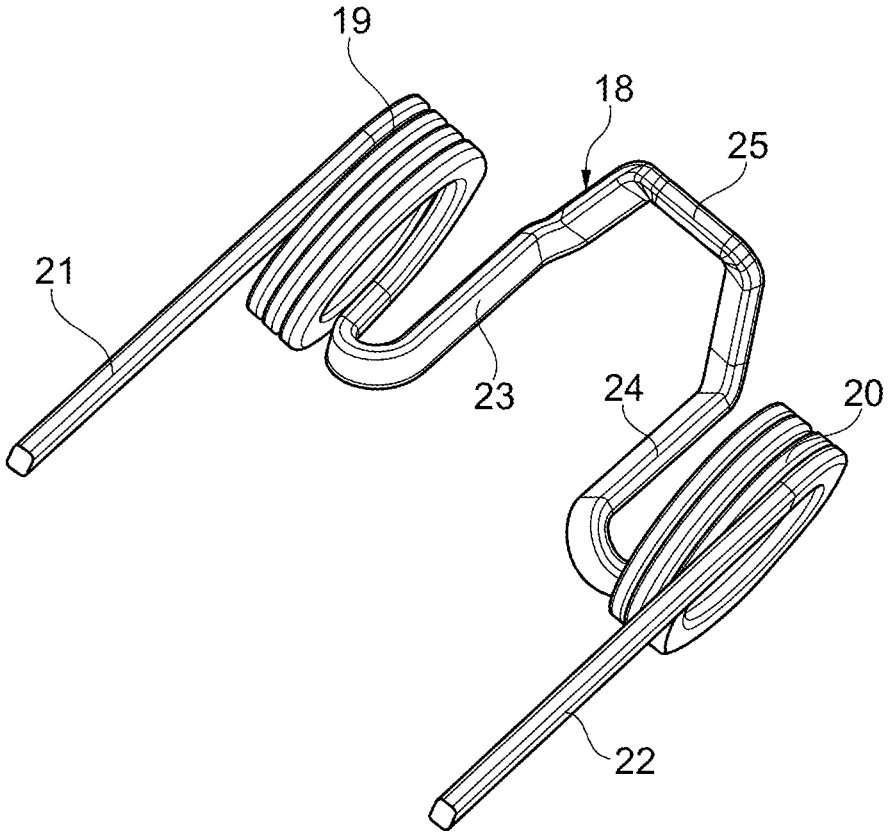
FIG. 3 is a perspective view of a first embodiment of a spring for the finger follower of FIGS. 1 and 2.
Figure 4:
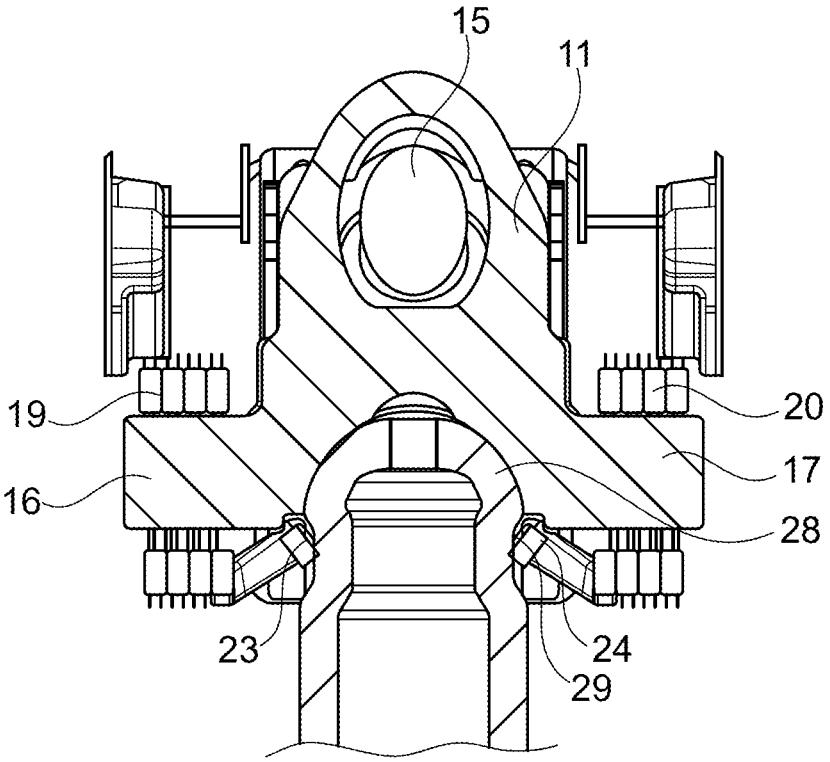
FIG. 4 is a partial cross-sectional view of an inner elongated body of the finger follower with a hydraulic lash adjuster.

The switchable roller finger follower 1 includes at least one spring 18 having two coiled spring portions 19, 20. Each of the two coiled spring portions 19, 20 is wrapped around a respective one of the spring holding pins 16, 17. Each one of the at least two coiled spring portions 19, 20 includes a first leg 21, 22 and a second leg 23, 24. Each of the first legs 21, 22 extends from a respective one of the two coiled spring portions 19, 20 to engage in or under a respective one of the spring pallets 8, 9. As shown in FIG. 4, each of the second legs 23, 24 contacts the bottom portion of the inner elongated body 11 in proximity to the socket portion 14 to act as a retainer for retaining a hydraulic lash adjuster 28 having a complementary retaining recess 29 with the inner elongated body 11. FIG. 3 shows a first preferred embodiment of the spring 18 in which the second legs 23, 24 of the two coiled spring portions 19, 20 are formed integrally with each other and define a common second leg 25, so that only one spring is required. The common second leg 25 can engage a spring catch protrusion 26 formed on the inner elongated body 11. This spring has the advantage that it is form-locked in position on the inner body 11 once installed. The first legs 21, 22 can extend across the inner cavity 10 of the outer elongated body 2 and engage a spring pallet 8, 9 located on an opposite side of the outer elongated body 2 from the one of the at least two coiled spring portions 19, 20 from which the first leg 21, 22 extends.

Figure 5:
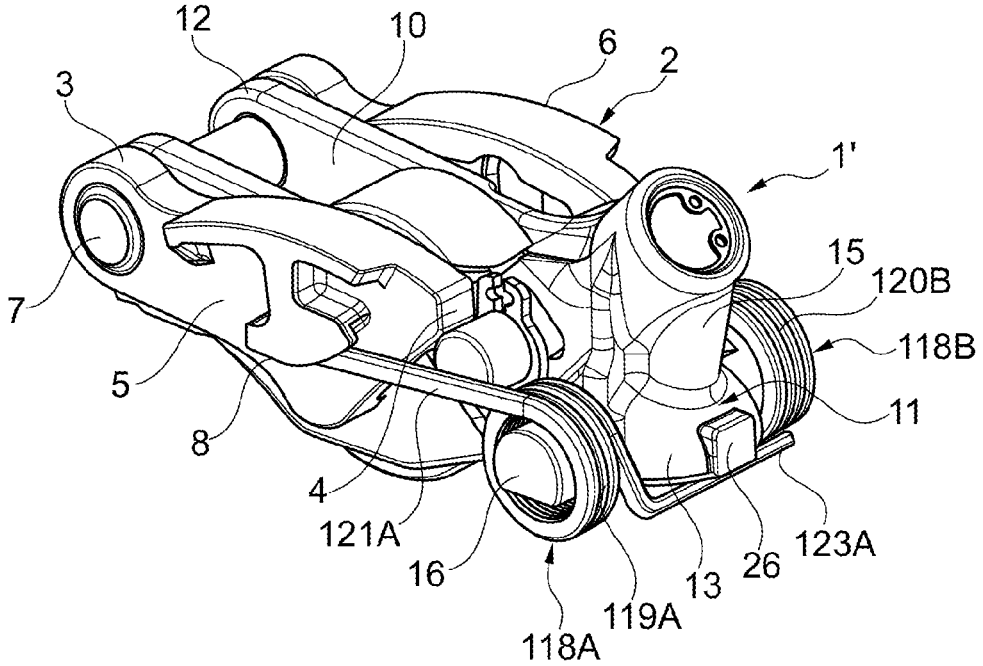
FIG. 5 is a perspective view of a finger follower according to a second embodiment of the present invention.
Figure 6:
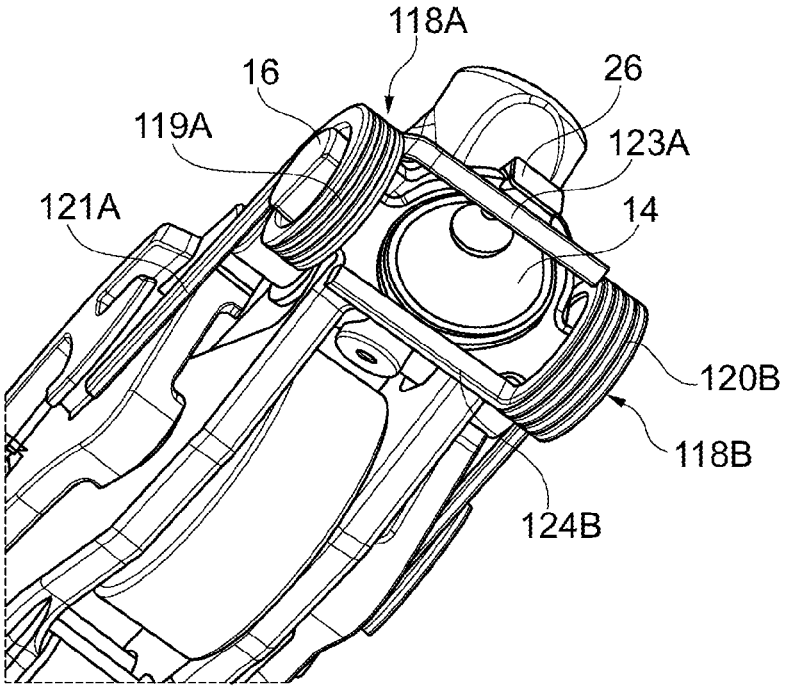
FIG. 6 is a perspective view of a bottom portion of the finger follower of FIG. 5.

Referring now to FIGS. 5 and 6, a second embodiment of a switchable roller finger follower 1' is shown. The second embodiment is the same as the first embodiment, except the finger follower 1' includes two separate springs 118A and 118B. Each of the springs 118A, 118B, includes a coiled spring portion 119A, 120B, a first leg 121A, 122B, and a second leg 123A, 124B. In the embodiment shown in FIGS. 5 and 6, the second legs 123A, 124B both engage the bottom portion of the inner elongated body 11 and extend in opposite transverse directions on opposite sides of the socket portion 14. In the embodiment shown in FIGS. 5 and 6, the spring catch protrusion 26 is formed on the second end 13 of the inner elongated body 11. In this embodiment, one of the second legs 123A engages a bottom portion of the spring catch protrusion 26. In another embodiment (not shown), the spring catch protrusion 26 is formed on an inner surface of the inner elongated body 11. One of ordinary skill in the art will recognize from the present disclosure that the spring catch protrusion 26 can be provided on various portions of the inner elongated body 11.

Figure 7:
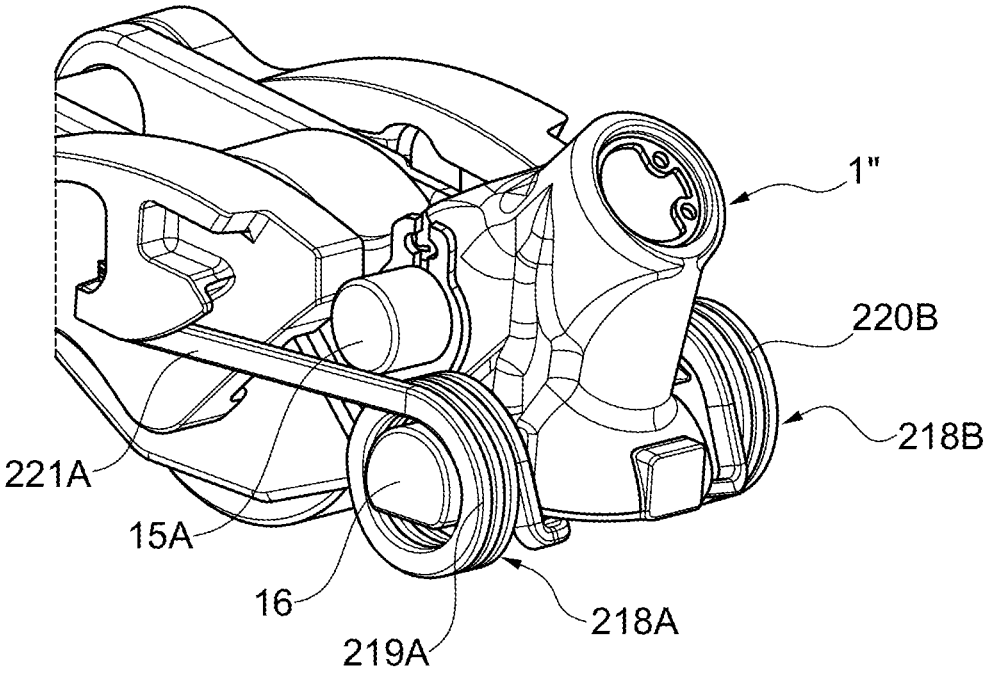
FIG. 7 is perspective view of a finger follower according to a third embodiment of the present invention.
Figure 8:
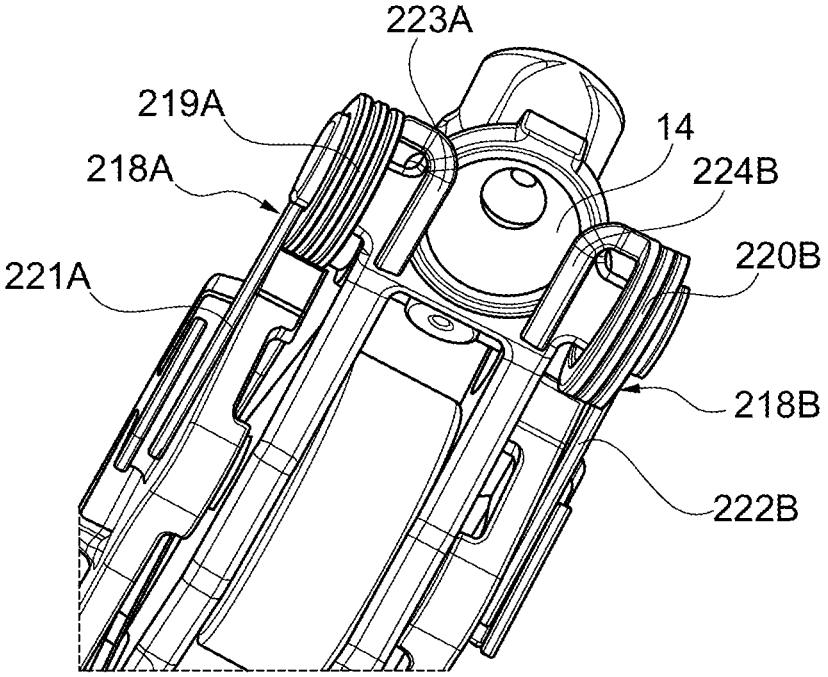
FIG. 8 is a perspective view of a bottom portion of the finger follower of FIG. 7.
Figure 9:
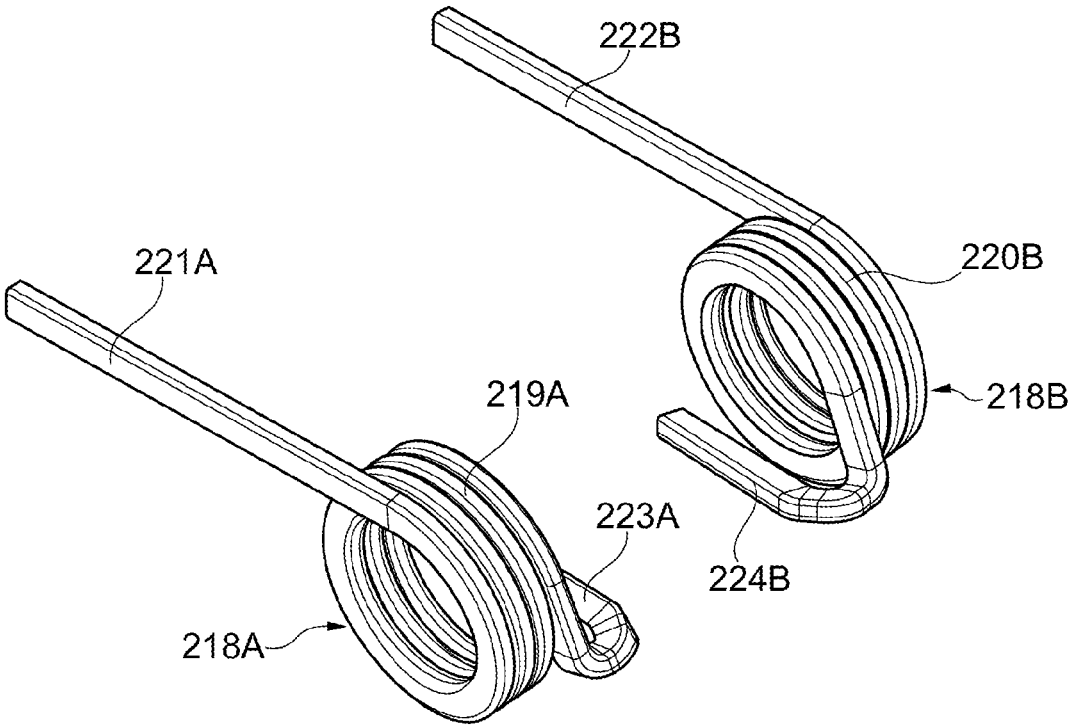
FIG. 9 is a perspective view of the springs used in the third embodiment of the finger follower shown in FIGS. 7 and 8.

Referring now to FIGS. 7-9, a third embodiment of a switchable roller finger follower 1" is shown. In this embodiment, two separately formed springs 218A, 218B are provided, each including respectively a coiled portion 219A, 220B, a first leg 221A, 222B, and a second leg 223A, 224B. The finger follower 1" is the same as the finger follower 1' of the second embodiment, except the second legs 223A, 224B engage the bottom portion of the inner elongated body 11 and extend in opposite longitudinal directions on opposite sides of the socket portion 14, as shown in FIGS. 7 and 8.

Although the embodiments described above include an inner elongated body including the socket portion and locking mechanism, one of ordinary skill in the art will recognize that the outer elongated body could include the socket portion and locking mechanism for a hydraulic lash adjuster.

Having thus described various embodiments of the present switchable roller finger follower in detail, it is to be appreciated and will be apparent to those skilled in the art that many changes, only a few of which are exemplified in the detailed description above, could be made in the finger follower without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

LOG TO REFERENCE NUMBERS

1, 1', 1" Switchable roller finger follower
2 Outer elongated body
3 Valve stem end
4 Lash adjuster end
5, 6 Side walls of outer elongated body
7 Pin
8, 9 Spring pallets
10 Inner cavity
11 Inner elongated body
12 First end of inner elongated body
13 Second end of inner elongated body
14 Socket portion
15 Locking mechanism
15A, 15B Locking pins
16, 17 Spring holding pins
18 Spring
118A, 118B Springs
218A, 218B Springs
19, 20 Coiled spring portions
119A, 120B Coiled spring portions
219A, 220B Coiled spring portions
21, 22 First legs
121A, 122B First legs
221A, 222B First legs
23, 24 Second legs
123A, 124B Second legs
223A, 224B Second legs
25 Common second leg
26 Spring catch protrusion
28 Hydraulic lash adjuster
29 Recess on hydraulic lash adjuster

What is claimed is:

1. A switchable roller finger follower comprising:

an outer elongated body having a valve stem end, a lash adjuster end, two outer elongated body side walls connected by a pin each including a spring pallet, and an inner cavity located between the outer elongated body side walls;

an inner elongated body positioned in said inner cavity and having a first end pivotally attached to said outer elongated body at said valve stem end via the pin, and a second, hydraulic lash adjuster end, a socket portion defined at the second end on a bottom portion of the inner elongated body, a locking mechanism located at the second end of the inner elongated body adapted to be switchable from a first locked position in which locking pins extend outwardly from the inner elongated body to engage under the lash adjuster ends of the outer elongated body side walls, to a second unlocked position in which the locking pins move inwardly so that the outer elongated body is pivotable in relation to the inner elongated body about the pin, and two spring holding pins located on opposite sides of the inner elongated body at the second end; and at least one spring that includes two coiled spring portions, each of the two coiled spring portions is wrapped around a respective one of the spring holding pins, and each one of the at least two coiled spring portions includes a first leg and a second leg, each of the first legs extends from a respective one of the two coiled spring portions to engage a respective one of the spring pallets, and each of the second legs contacts the bottom portion of the inner elongated body in proximity to the socket portion to act as a retainer for a hydraulic lash adjuster with the inner elongated body.

2. The switchable roller finger follower of claim 1, wherein each spring pallet is located on a bottom portion of the outer elongated body.

3. The switchable roller finger follower of claim 1, wherein the second legs of the two coiled spring portions are formed integrally with each other defining a common second leg.

4. The switchable roller finger follower of claim 3, wherein the common second leg engages a spring catch protrusion formed on the inner elongated body.

5. The switchable roller finger follower of claim 4, wherein the spring catch protrusion is formed on the second end of the inner elongated body.

6. The switchable roller finger follower of claim 4, wherein the spring catch protrusion is formed on an inner surface of the inner elongated body.

7. The switchable roller finger follower of claim 1, wherein the at least one spring comprises two separate springs, and the second legs engage the bottom portion of the inner elongated body and extend in opposite longitudinal directions on opposite sides of the socket portion.

8. The switchable roller finger follower of claim 1, wherein the at least one spring comprises two separate springs, and the second legs engage the bottom portion of the inner elongated body and extend in opposite transverse directions on opposite sides of the socket portion.

9. The switchable roller finger follower of claim 1, wherein the first legs extend across the inner cavity and engage a spring pallet located on an opposite side of the outer elongated body from the one of the at least two coiled spring portions from which the first leg extends.

10. A switchable roller finger follower comprising:

a primary lever including a valve stem end and a lash adjuster end including a socket portion defined on a bottom portion of the primary lever;

a secondary lever including a first end, a second end, and spring pallets, at least one of the first and second ends is pivotally attached to the primary lever via a pin;

a locking mechanism located at the lash adjuster end of the primary lever adapted to be switchable from a first locked position in which locking pins extend to engage the secondary lever, to a second unlocked position in which the locking pins move so that the secondary lever is pivotable in relation to the primary lever about the pin, and two spring holding pins located on opposite sides of the primary lever at the lash adjuster end of the primary lever;

at least one spring that includes two coiled spring portions, each of the two coiled spring portions is wrapped around a respective one of the spring holding pins, and each one of the at least two coiled spring portions includes a first leg and a second leg, each of the first legs extends from a respective one of the two coiled spring portions to engage a respective one of the spring pallets, and each of the second legs contacts the bottom portion of the primary lever in proximity to the socket portion to act as a retainer for a hydraulic lash adjuster with the primary lever.

11. The switchable roller finger follower of claim 10, wherein the secondary lever includes a cam-support portion.

12. The switchable roller finger follower of claim 10, wherein the primary lever includes two outer elongated body side walls that define an inner cavity, and the secondary lever is positioned in the inner cavity of the primary lever.

13. The switchable roller finger follower of claim 10, wherein the secondary lever includes two outer elongated body side walls, and each of the two outer elongated body side walls includes one of the spring pallets.

* * * * *